United States Patent [19]

Tanizaki et al.

[11] 4,298,488

[45] Nov. 3, 1981

[54] HYDRAULIC FLUID COMPOSITION CONTAINING GLYCOL ETHERS AND BORATE ESTER

[75] Inventors: Yoshiharu Tanizaki; Kenichiro Minagawa, both of Yokohama; Yoshinori Takano, Tokyo, all of Japan

[73] Assignee: Nippon Oil and Fats Co., Ltd., Tokyo, Japan

[21] Appl. No.: 68,697

[22] Filed: Aug. 22, 1979

[30] Foreign Application Priority Data

Aug. 26, 1978 [JP] Japan ..... 53-104297

[51] Int. Cl.[3] ..... C09K 5/00; C10M 3/16; C10M 3/20

[52] U.S. Cl. ..... 252/78.1; 252/49.6; 252/52 A; 252/73

[58] Field of Search ..... 252/78.1, 73, 49.6, 252/52 A

[56] References Cited

U.S. PATENT DOCUMENTS

| | | | |
|---|---|---|---|
| 3,711,410 | 1/1973 | Sawyer et al. | 252/78.1 |
| 3,957,667 | 5/1976 | Tanizaki et al. | 252/73 |
| 3,972,822 | 8/1976 | Sato et al. | 252/78.1 |

FOREIGN PATENT DOCUMENTS 52-1234077 4/1977 Japan .

*Primary Examiner*—Dennis L. Albrecht

*Attorney, Agent, or Firm*—Stevens, Davis, Miller & Mosher

[57] ABSTRACT

A hydraulic fluid composition comprising polyoxyalkylene glycol monoalkyl ether, polyoxyalkylene glycol dialkyl ether, borate ester of polyoxyalkylene glycol monoalkyl ether, and high molecular weight polyoxyalkylene compound, has improved viscosity characteristics, is water-insensitive and is suitable as a central system hydraulic fluid and brake fluid.

5 Claims, No Drawings

HYDRAULIC FLUID COMPOSITION CONTAINING GLYCOL ETHERS AND BORATE ESTER

BACKGROUND OF THE INVENTION (1) Field of the Invention:

The present invention relates to a hydraulic fluid composition, and more particularly to a hydraulic fluid composition for automobile.

(2) Description of the Prior Art:

Central hydraulic system for automobile has been developed in order to satisfy the requirements demanded to the safe and high speed running of automobile. As the specifications for hydraulic fluids used in the central hydraulic system, SAE 71R1 (for mineral oil base hydraulic fluid) and SAE 71R2 (for synthetic oil base hydraulic fluid) are enacted in U.S.A.

In this central hydraulic system, one hydraulic fluid is used as a multipurpose hydraulic fluid for brake, power steering, automatic transmission, shock absorber, windshield wiper, seat actuator, window actuator and the like. Therefore, it is necessary that this hydraulic fluid satisfys various demands.

The synthetic base fluid for central system hydraulic fluid is demanded to have the following properties. That is, the fluid (a) has a high viscosity index, (b) is fluidable at low temperature, (c) has a high boiling point and a high flash point, (d) is excellent in the shear stability, (e) does not swell sealing material (rubber), (f) is excellent in the lubricating property, and (e) is stable against oxidation.

The hydraulic fluid composition of the present invention satisfys all the SEA 71R2 specifications as a central system hydraulic fluid, and further can be used as a hydraulic fluid for each of the above described purposes. Particularly, the hydraulic fluid composition of the present invention satisfys all the DOT-4 specifications as a brake fluid.

Polyoxyalkylene series hydraulic fluids for automobile are disclosed in U.S. Pat. No. 3,957,667 and Japanese Patent Application Publication No. 12,340/77. However, the hydraulic fluid composition disclosed in the U.S. patent is insufficient in the wet equilibrium reflux boiling point, and that disclosed in the Japanese patent application publication is insufficient in the viscosity characteristics, and therefore both the hydraulic fluid compositions cannot satisfy both the SAE 71R2 and the DOT-4 specifications.

SUMMARY OF THE INVENTION

The inventors have made various investigations and found out a hydraulic fluid composition having a more improved wet equilibrium reflux boiling point and further having more excellent viscosity characteristics and other improved properties by combining the following four components.

The feature of the present invention is the provision of a hydraulic fluid composition consisting mainly of (A) 20–60% by weight of polyoxyalkylene glycol monoalkyl ether having the following general formula (1), (B) 1–25% by weight of polyoxyalkylene glycol dialkyl ether having the following general formula (2), (C) 15–50% by weight of borate ester of polyoxyalkylene glycol monoalkyl ether having the following general formula (3), $$R^1O(C_mH_{2m}O)_nH \quad (1)$$

$$R^1O(C_mH_{2m}O)_nR^2 \quad (2)$$

$$[R^1O(C_mH_{2m}O)_n]_3B \quad (3)$$

wherein $R^1$ and $R^2$ represent alkyl groups having 1-3 carbon atoms, $C_mH_{2m}O$ represents an oxyalkylene group, m represents a positive integer of 2-4, and n represents a positive integer of 2-6, and the oxyethylene group content in the total oxyalkylene group of the compounds (1), (2) and (3) is 40–90% by weight; and (D) 1–25% by weight of a high molecular weight polyoxyalkylene compound having a kinematic viscosity of at least 8 cst at 100° C. and containing at least 90% by weight of polyoxyalkylene group in the molecule and 15–80% by weight of oxyethylene group based on the total oxyalkylene group in the molecule.

In the specification, the polyoxyalkylene glycol monoalkyl ether having the general formula (1) is referred to as monoether, the polyoxyalkylene glycol dialkyl ether having the general formula (2) is referred to as diether, and the borate ester of polyoxyalkylene glycol monoalkyl ether having the general formula (3) is referred to as borate ester.

When the above described high molecular weight polyoxyalkylene compound contains 40–70% by weight of oxyethylene group based on the total oxyalkylene group in the molecule, the resulting hydraulic fluid composition has an improved performance. Further, the solidifying point of the high molecular weight polyoxyalkylene compound is preferred to be not higher than 0° C., and the kinematic viscosity thereof is preferred to be 50–50,000 cst at 100° C.

DESCRIPTION OF THE PREFERRED EMBODIMENTS

The limitation in the compounds having the above described formulae (1), (2) and (3) is based on the following reason.

When $R^1$ and $R^2$ are alkyl groups having 4 or more carbon atoms, the resulting hydraulic fluid causes swelling of rubber, and is not favorable.

When less than 2 moles of alkylene oxide is added to the alcohol, the resulting hydraulic fluid has excessively low boiling point and flash point, while when more than 6 moles of alkylene oxide is added to the alcohol, the resulting hydraulic fluid is poor in the low temperature viscosity characteristics and fluidity. When the oxyethylene group content in the total oxyalkylene group is less than 40% by weight, the resulting hydraulic fluid causes swelling of rubber, and further has a low wet equilibrium reflux boiling point (hereinafter, abbreviated as WER), while when the oxyethylene group content is more than 90% by weight, the resulting hydraulic fluid is apt to be solidified at low temperature and is poor in the fluidity at low temperature.

When the content of the monoether of the formula (1) in a hydraulic fluid is less than 20% by weight, the fluid causes swelling of rubber and is low in the WER. While, when the monoether content is more than 60% by weight, the hydraulic fluid is poor in the low temperature viscosity characteristics.

When the content of the diether of formula (2) in a hydraulic fluid is less than 1% by weight, the hydraulic fluid is poor in the low temperature viscosity characteristics, while when the diether content exceeds 25% by weight, the hydraulic fluid causes swelling of rubber.

When the content of the borate ester of the formula (3) in a hydraulic fluid is less than 15% by weight, the hydraulic fluid is low in the dry equilibrium reflux boiling point (hereinafter, abbreviated as DER) and in the WER. While, when the borate ester content exceeds 50% by weight, the hydraulic fluid is poor in the low temperature viscosity characteristics and has unfavorably a high pour point.

In order to improve the viscosity index of the resulting hydraulic fluid, it is necessary that the high molecular weight polyoxyalkylene compound has a kinematic viscosity of at least 8 cst, preferably 50-50,000 cst, at 100° C. When the kinematic viscosity exceeds 50,000 cst, the resulting hydraulic fluid is poor in the low temperature fluidity and shear stability. In order that the hydraulic fluid composition aimed in the present invention has a kinematic viscosity within the defined range, it is necessary that the high molecular weight polyoxyalkylene compound contains at least 90% by weight of polyoxyalkylene group and further contains 15-80% by weight of oxyethylene group based on the total oxyalkylene group. When the oxyethylene group content in the total polyoxyalkylene group is less than 15% by weight or more than 80% by weight, the resulting hydraulic fluid is poor in the low temperature viscosity characteristics.

The use of less than 1% by weight of the high molecular weight polyoxyalkylene compound cannot sufficiently improve the viscosity index or decrease the rubber swelling of the resulting hydraulic fluid. While, the use of more than 25% by weight of the high molecular weight polyoxyalkylene compound results a hydraulic fluid having a poor low temperature viscosity characteristics and a high pour point. Further, when a hydraulic fluid contains the defined amount of the high molecular weight polyoxyalkylene compound, the corrosion and abrasion of metal are suppressed, and the volatilization of the fluid is very small at the heating.

The hydraulic fluid composition of the present invention can be obtained by a method, wherein a monoether of the formula (1), a diether of the formula (2), a borate ester of the formula (3) and a high molecular weight polyoxyalkylene compound are synthesized separately, and the resulting four compounds are mixed in a given mixing ratio. Alternatively, the hydraulic fluid composition can be advantageously obtained by the following method.

That is, a monoether is prepared by a random or block addition polymerization of ethylene oxide (hereinafter, abbreviated as EO), propylene oxide (PO) or butylene oxide (BO) to methanol, ethanol, n-propanol or isopropanol at a temperature of 60°-160° C. in the presence of an alkali metal compound as a catalyst. Then, the resulting monoether is reacted with 0.01-0.33 equivalent amount of an alkali metal or alkali metal compound, such as metallic sodium, sodium methylate, sodium hydroxide or the like, at 40°-200° C. for about 2 hours, if necessary under a vacuum degree of not higher than 30 mmHg to convert partly the monoether into alkali metal salt, and the resulting alkali metal salt is reacted with methyl chloride, ethyl chloride or propyl chloride at 40°-180° C., after which the resulting alkali metal chloride as a by-product is removed from the reaction product to obtain a mixture composed of 1-33% by weight of a diether and 67-99% by weight of the monoether. Then, the resulting mixture is reacted with 0.050-0.223 equivalent amount of boric acids, for example, boric acid anhydride, orthoboric acid, metaboric acid, pyroboric acid or the like, at 50°-200° C. for 2-15 hours under a reduced pressure of 10-80 mmHg to obtain a three-component mixture composed of 15-66.7% by weight of a borate ester, 20-80% by weight of the monoether and 1-33.3% by weight of the diether.

When 75-99% by weight of the resulting three-component mixture of monoether, diether and borate ester is mixed with 1-25% by weight of a high molecular weight polyoxyalkylene compound so that the resulting mixture contains 20-60% by weight of the monoether, 1-25% by weight of the diether, 15-50% by weight of the borate ester and 1-25% by weight of the high molecular weight polyoxyalkylene compound, the hydraulic fluid composition aimed in the present invention can be obtained.

The high molecular weight polyoxyalkylene compound can be obtained by an addition polymerization of a mixture of EO and other alkylene oxide, such as PO, BO or the like, to a compound having active hydrogen, for example, aliphatic alcohol or amine, at 80°-150° C. in the presence of an alkali metal compound. As the active hydrogen-containing compound, there can be used monohydric alcohols, such as methanol, ethanol, propanol, butanol and the like; and polyhydric alcohols, such as ethylene glycol, propylene glycol, butylene glycol, glycerine, trimethylolpropane and the like. Among them, lower monohydric alcohols are preferably used. The high molecular weight polyoxyalkylene compound obtained by the addition polymerization of a mixture of EO and other alkylene oxide, such as PO, BO or the like, to the active hydrogen-containing compound can be used as such. Further, as the high molecular weight polyoxyalkylene compound, there may be used modified polyoxyalkylene compound, which is obtained by alkyl-etherifying or esterifying the terminal hydroxyl group of the high molecular weight polyoxyalkylene compound, or obtained by reacting methylene dihalogenide or formaldehyde with the terminal OH group of the high molecular weight polyoxyalkylene compound according to the method described in U.S. Pat. Nos. 2,813,129 and 2,976,923.

The hydraulic fluid composition of the present invention can be used in combination with antifoaming agent, antioxidant, abrasion-preventing agent, anti-corrosive agent or oiliness-improving agent.

The following examples are given for the purpose of illustration of this invention and are not intended as limitations thereof. In the examples "%" means by weight unless otherwise indicated.

EXAMPLE 1

Production of monoether, diether and borate ester

Into an airtight reaction vessel were charged 3.2 kg (100 moles) of methanol and 0.2 kg of potassium hydroxide, and an addition polymerization of a mixture composed of 9.8 kg (222 moles) of EO and 4.2 kg (72 moles) of PO (weight ratio of EO/PO is 70/30) to the methanol was effected at 80°-120° C. under a pressure of 0.5-5.0 kg/cm$^2$ in nitrogen gas atmosphere to obtain 17 kg of crude polyoxyethylene-propylene glycol monomethyl ether.

Then, 170 g of the resulting crude polyoxyethylene-propylene glycol monomethyl ether was added with 1.0 g of active clay, dehydrated at 60°-90° C. for 1 hour under a vacuum degree of not higher than 50 mmHg in nitrogen gas atmosphere, and then dried to obtain 165 g of purified polyoxyethylenepropylene glycol monomethyl ether (monoether No. 1). Which had a hydroxyl value of 324 and an average molecular weight of 173.

To 15.6 kg (90 moles) of the above obtained crude polyoxyethylene-propylene glycol monomethyl ether was added 0.63 kg (11.7 moles) of sodium methylate, and the resulting mixture was heated at 70°-120° C. for 1 hour under a reduced pressure of 50 mmHg in nitrogen gas atmosphere to convert the terminal hydroxyl group into sodium salt by the conversion of the methylate into methanol. Then, methyl chloride gas was introduced into the reaction system at this temperature to effect a methyl-etherification reaction until the alkali value of the reaction product was not higher than 1.0, and then the reaction product was filtered to obtain 15.0 kg of a mixture (mixed ether No. 11) of monomethyl ether and dimethyl ether of polyoxyethylene-propylene glycol, which had a hydroxyl value of 273, a dimethyl ether content of 15% and an average molecular weight of 175.

Further, 14 kg (80 moles) of the above obtained mixed ether No. 11 was reacted with 0.234 kg (3.36 moles) of boric acid anhydride at 70°-100° C. for 4 hours under a reduced pressure of 15-50 mmHg in nitrogen gas atmosphere to obtain 13 kg of a three-component mixture (three-component mixture No. 111) composed of polyoxyethylene-propylene glycol monomethyl ether and dimethyl ether, and borate ester of polyoxyethylene-propylene glycol monomethyl ester. The yield of the resulting three-component mixture No. 111 was 93% based on the amount of mixed ether No. 11. The three-component mixture No. 111 contained 58% of monoether, 15% of diether and 27% of borate ester.

In the same manner as described above, monoethers, mixed ethers and three-component mixtures shown in the following Table 1 were produced.

TABLE 1(a)

| Monoether No. | Mixed ether No. | Three-component mixture No. | $R^1$ | $R^2$ | n | EO:PO:BO | Content (%) Monoether | Diether | Borate ester |
|---|---|---|---|---|---|---|---|---|---|
| 1 | | | methyl | — | 2.94 | 70:30:0 | 100 | 0 | 0 |
| | 11 | | " | methyl | " | " | 85 | 15 | 0 |
| | | 111 | " | " | " | " | 58 | 15 | 27 |
| | | 112 | " | " | " | " | 33 | 15 | 52 |
| | | 113 | " | " | " | " | 24 | 15 | 61 |
| | 12 | | " | ethyl | " | " | 92 | 8 | 0 |
| | | 121 | " | " | " | " | 79 | 8 | 13 |
| | | 122 | " | " | " | " | 67 | 8 | 25 |
| 2 | | | isopropyl | — | 3.15 | 75:15:10 | 100 | 0 | 0 |
| | 21 | | " | methyl | " | " | 79 | 21 | 0 |
| | | 211 | " | " | " | " | 36 | 21 | 43 |
| | | 212 | " | " | " | " | 20 | 21 | 59 |
| | 22 | | " | " | " | " | 65 | 35 | 0 |
| | | 221 | " | " | " | " | 23 | 35 | 42 |
| | 23 | | " | " | " | " | 75 | 25 | 0 |
| | | 231 | " | " | " | " | 33 | 25 | 42 |
| 3 | | | methyl | — | 3.41 | 66:34:10 | 100 | 0 | 0 |
| | | 301 | " | — | " | " | 54 | 0 | 46 |
| | 31 | | " | methyl | " | " | 90 | 10 | 0 |
| | | 311 | " | " | " | " | 43 | 10 | 47 |

TABLE 1(b)

| Monoether No. | Mixed ether No. | Three-component mixture No. | $R^1$ | $R^2$ | n | EO:PO:BO | Content (%) Monoether | Diether | Borate ester |
|---|---|---|---|---|---|---|---|---|---|
| 4 | | | methyl | — | 2.87 | 65:35:0 | 100 | 0 | 0 |
| | | 401 | " | — | " | " | 65 | 0 | 35 |
| | | 402 | " | — | " | " | 39 | 0 | 61 |
| | 41 | | " | methyl | " | " | 90 | 10 | 0 |
| | | 411 | " | " | " | " | 66 | 10 | 24 |
| | | 412 | " | " | " | " | 54 | 10 | 36 |
| | 42 | | " | " | " | " | 77 | 23 | 0 |
| | | 421 | " | " | " | " | 63 | 23 | 14 |
| | | 422 | " | " | " | " | 54 | 23 | 23 |
| | 43 | | " | " | " | " | 72 | 28 | 0 |
| | | 431 | " | " | " | " | 48 | 28 | 24 |
| *5 | | | methyl | — | 3.04 | 35:65:0 | 100 | 0 | 0 |
| | *51 | | " | methyl | " | " | 83 | 17 | 0 |
| | | *511 | " | " | " | " | 38 | 17 | 45 |

(Note)
*Content of oxyethylene group in the total oxyalkylene group is outside the range of the present invention.

EXAMPLE 2

Production of a high molecular weight polyoxyalkylene compound.

Into an autoclave were charged 80 g of n-butanol and 11 g of potassium hydroxide, and an addition polymerization of a mixture of 5.2 kg of EO and 5.2 kg of PO (weight ratio of EO/PO is 50:50) to the n-butanol was effected at 80°-120° C. for 10 hours under a pressure of 0.5-5.0 kg/cm$^2$ in a nitrogen gas atmosphere. The reaction product was neutralized with hydrochloride acid, added with 10 kg of toluene and washed with 20 kg of warm water at 60°-90° C. Then, the toluene was removed from the above treated reaction product, and the reaction product was filtered to obtain 10.2 kg of polyoxyethylene-propylene glycol monobutyl ether (PAG 1), which had a hydroxyl value of 14.1, an average molecular weight of 3,980 and a kinematic viscosity at 100° C. of 169 cst.

In the same reaction as described above, high molecular weight polyoxyalkylene compounds (PAGs 1–6) shown in the following Table 2 were produced. In Table 2, PAG 2 was produced by butyl-etherified the terminal hydroxyl group with the use of n-butyl chloride, and PAG 4 was produced by dimerizing PAG 1 with the use of methylene chloride.

Further, comparative compounds, which have a similar structure to that of the high molecular weight polyoxyalkylene compound of the present invention and are used in the comparative examples, are also shown in Table 2.

TABLE 2

| High molecular weight polyoxyalkylene compound | | Weight ratio of added alkylene oxides EO:PO:BO | Hydroxyl value | Average molecular weight | Kinematic viscosity at 100° C. (cst) | Pour point (°C.) |
|---|---|---|---|---|---|---|
| PAG 1 | Polyoxyethylene-propylene glycol mono-n-butyl ether | 50:50:0 | 14.1 | 3,980 | 169 | −33 |
| PAG 2 | Polyoxyethylene-propylene glycol mono-n-butyl ether | " | 7.7 | 7,290 | 2,060 | −29 |
| PAG 3 | Polyoxyethylene-propylene glycol di-n-butyl ether | " | 1.1 | about 4,040 | 161 | −32 |
| PAG 4 | Dimer of PAG 1 through an oxymethylene group | " | 1.5 | about 6,500 | 393 | −30 |
| PAG 5 | Polyoxyethylene-propylene glycol | 65:35:0 | 23.3 | 4,810 | 172 | −15 |
| PAG 6 | Polyoxyethylene-propylene glycol glycerine ether | 70:20:10 | 10.5 | 16,000 | 2,070 | −9 |
| Comparative compound 1 | Polyethylene glycol PEG #6000 | 100:0:0 | 13.5 | 8,340 | 811 | 57.3 (1) |
| Comparative compound 2 | Polyethylene glycol PEG #20000 | 100:0:0 | 5.75 | 19,500 | 12,300 | 58.4 (1) |
| Comparative compound 3 | Polypropylene glycol PPG #3000 | 0:100:0 | 37.8 | 2,970 | 47.5 | −29 |

Note:
(1) Solidifying point

EXAMPLE 3

SAE 71R2 specifications for hydraulic fluid and DOT-4 specifications for brake fluid are shown in the following Table 3. The composition of hydraulic fluids prepared from the compound or mixture listed in Table 1 and the high molecular weight polyoxyalkylene compound listed in Table 2 is shown in the following Table 4, and the properties of the fluids are shown in the following Table 5.

TABLE 3

Specifications for hydraulic fluid and brake fluid

| Test | SAE 71R2 | DOT-4 | Values satisfying both SAE 71R2 and DOT-4 specifications |
|---|---|---|---|
| Kinematic viscosity at 100° C. (cst) | (2) (4.5 min.) | 1.5 min. | 4.5 min. |
| at −40° C. (cst) | 1,800 max. | 1,800 max. | 1,800 max. |
| Kinematic viscosity (after shear test) (1) at 98.9° C. (cst) | 4.5 min. | — | 4.5 min. |
| Boiling point | | | |
| Dry equilibrium reflux boiling point (DER) (°C.) | 204.4 min. | 230 min. | 230 min. |
| Wet equilibrium reflux boiling point (WER) (°C.) | — | 155 min. | 155 min. |
| Pour point (° C.) | −56.7 max. | −50 max. | −56.7 max. |
| Flash point (°C.) | 96.1 min. | 100 min. | 100 min. |
| Rubber swelling (mm) SBR, 120° C. × 70 hrs. | 0.1–1.4 | 0.15–1.4 | 0.15–1.4 |

Note
(1) An ultrasonic shearing apparatus is used. test temperature: 37.8° C., irradiation time: 30 minutes.
(2) Kinematic viscosity at 100° C. is not specified, but kinematic viscosity at 100° C. must be at least 4.5 cst before shear test in order to meet the kinematic viscosity of at least 4.5 cst after shear test.

TABLE 4

Composition of hydraulic fluid

| | Three components | | | | | High molecular weight polyoxyalkylene compound | |
|---|---|---|---|---|---|---|---|
| | Component | Mixing | Content (%) | | | | |
| Sample No. | in Table 1 | ratio (%) | Monoether | Diether | Borate ester | PAG in Table 2 | Mixing ratio (%) |
| 1 | 11 | 91.5 | 77.8 | 13.7 | 0 | PAG 2 | 8.5 |
| 2 | 111 | 100.0 | 58.0 | 15.0 | 27.0 | — | 0 |
| 3 | 111 | 93.9 | 54.5 | 14.1 | 25.3 | PAG 2 | 6.1 |
| 4 | 111 | 74.0 | 42.9 | 11.1 | 20.0 | PAG 1 | 26.0 |
| 5 | 112 | 95.6 | 31.6 | 14.4 | 49.6 | PAG 2 | 4.4 |
| 6 | 113 | 96.6 | 23.2 | 14.5 | 58.9 | " | 3.4 |
| 7 | 112 | 94.4 | 31.1 | 14.2 | 49.1 | Comparative compound 1 | 5.6 |
| 8 | 121 | 93.0 | 73.5 | 7.4 | 12.1 | PAG 6 | 7.0 |
| 9 | 122 | 87.5 | 58.6 | 7.0 | 21.9 | PAG 1 | 12.5 |
| 10 | 21 | 81.8 | 64.6 | 17.2 | 0 | PAG 5 | 18.2 |
| 11 | 211 | 90.5 | 32.6 | 19.0 | 38.9 | " | 9.5 |

TABLE 4-continued

| Sample No. | Composition of hydraulic fluid: Three components: Component in Table 1 | Mixing ratio (%) | Content (%): Monoether | Diether | Borate ester | High molecular weight polyoxyalkylene compound: PAG in Table 2 | Mixing ratio (%) |
|---|---|---|---|---|---|---|---|
| 12 | 212 | 91.9 | 18.4 | 19.3 | 54.2 | " | 8.1 |
| 13 | 211 | 96.7 | 34.8 | 20.3 | 41.6 | Comparative compound 2 | 3.3 |
| 14 | 22 | 81.5 | 53.0 | 28.5 | 0 | PAG 5 | 18.5 |
| 15 | 221 | 89.8 | 20.6 | 31.4 | 37.8 | " | 10.2 |
| 16 | 231 | 90.1 | 29.7 | 22.5 | 37.9 | " | 9.9 |
| 17 | 301 | 93.7 | 50.7 | 0 | 43.0 | PAG 4 | 6.3 |
| 18 | 31 | 82.9 | 74.6 | 8.3 | 0 | PAG 3 | 17.1 |
| 19 | 311 | 89.9 | 38.7 | 9.0 | 42.2 | " | 10.1 |
| 20 | 311 | 93.1 | 40.0 | 9.3 | 43.8 | PAG 4 | 6.9 |
| 21 | 311 | 80.2 | 34.5 | 8.0 | 37.7 | Comparative compound 3 | 19.8 |
| 22 | 401 | 96.9 | 63.0 | 0 | 33.9 | PAG 2 | 3.1 |
| 23 | 402 | 89.7 | 35.0 | 0 | 54.7 | PAG 1 | 10.3 |
| 24 | 411 | 94.2 | 62.2 | 9.4 | 22.6 | PAG 2 | 5.8 |
| 25 | 412 | 95.1 | 51.4 | 9.5 | 34.2 | " | 4.9 |
| 26 | 421 | 93.8 | 59.1 | 21.6 | 13.1 | " | 6.2 |
| 27 | 422 | 93.3 | 50.4 | 21.5 | 21.4 | " | 6.7 |
| 28 | 431 | 92.7 | 44.5 | 26.0 | 22.2 | " | 7.3 |
| 29 | 511 | 92.8 | 35.2 | 15.8 | 41.8 | PAG 4 | 7.2 |

TABLE 5(a)

| Sample No. | Properties of hydraulic fluid: Kinematic viscosity (cst): 100° C. | −40° C. | After shear test, 98.9° C. | Boiling point (°C.): DER | WER | Pour point (°C.) | Flash point (°C.) | Rubber swelling (mm) SBR 120° C. × 70 hrs. | Remarks |
|---|---|---|---|---|---|---|---|---|---|
| 1 | 4.56 | 1,480 | 4.55 | 235 | *137 | −65 | 107 | 1.02 | Comparative fluid |
| 2 | *1.97 | 912 | 1.95 | 238 | 159 | −65 | 113 | 1.18 | Comparative fluid |
| 3 | 4.54 | 1,540 | 4.54 | 241 | 157 | −65 | 115 | 0.77 | Fluid of the present invention |
| 4 | 10.75 | *7,950 | 10.58 | 252 | 155 | −63 | 118 | 0.61 | Comparative fluid |
| 5 | 4.57 | 1,650 | 4.56 | 257 | 174 | −63 | 119 | 0.85 | Fluid of the present invention |
| 6 | 4.53 | *1,910 | 4.53 | 277 | 178 | −62 | 123 | 0.94 | Comparative fluid |
| 7 | 4.54 | *solidify | 4.53 | 259 | 176 | *−32 | 118 | 0.80 | Comparative fluid |

TABLE 5(b)

| Sample No. | Properties of hydraulic fluid: Kinematic viscosity (cst): 100° C. | −40° C. | After shear test, 98.9° C. | Boiling point (°C.): DER | WER | Pour point (°C.) | Flash point (°C.) | Rubber swelling (mm) SBR, 120° C. × 70 hrs. | Remarks |
|---|---|---|---|---|---|---|---|---|---|
| 8 | 4.53 | *1,820 | 4.51 | 239 | *147 | −65 | 109 | 1.13 | Comparative fluid |
| 9 | 4.53 | 1,720 | 4.52 | 244 | 160 | −65 | 118 | 0.96 | Fluid of the present invention |
| 10 | 4.55 | 1,450 | 4.55 | 236 | *139 | −65 | 106 | 1.25 | Comparative fluid |
| 11 | 4.56 | 1,610 | 4.55 | 262 | 171 | −65 | 121 | 1.09 | Fluid of the present invention |
| 12 | 4.54 | *1,950 | 4.53 | 279 | 180 | −60 | 125 | 1.08 | Comparative fluid |
| 13 | 4.53 | *solidify | 4.53 | 261 | 172 | *−38 | 119 | 1.08 | Comparative fluid |

TABLE 5(c)

| Sample No. | Kinematic viscosity (cst) 100°C. | −40° C. | After shear test, 98.9° C. | Properties of hydraulic fluid: Boiling point (°C.) DER | WER | Pour point (°C.) | Flash point (°C.) | Rubber swelling (mm) SBR, 120° C. × 70 hrs. | Remarks |
|---|---|---|---|---|---|---|---|---|---|
| 14 | 4.54 | 1,520 | 4.54 | 235 | *135 | −65 | 108 | 1.22 | Comparative fluid |
| 15 | 4.53 | 1,640 | 4.52 | 256 | 168 | −62 | 122 | *1.61 | Comparative fluid |
| 16 | 4.54 | 1,710 | 4.53 | 254 | 170 | −65 | 121 | 1.20 | Fluid of the present invention |
| 17 | 4.53 | *2,140 | 4.53 | 261 | 170 | −65 | 124 | 0.94 | Comparative fluid |
| 18 | 4.52 | 1,510 | 4.51 | 241 | *139 | −65 | 106 | 1.06 | Comparative fluid |
| 19 | 4.53 | 1,640 | 4.53 | 262 | 169 | −65 | 121 | 0.92 | Fluid of the present invention |
| 20 | 4.55 | 1,590 | 4.54 | 261 | 170 | −65 | 120 | 0.95 | Fluid of the present invention |
| 21 | 4.56 | *2,570 | 4.56 | 261 | 162 | *−54 | 122 | 1.02 | Comparative fluid |

Note:
*This value does not pass the specifications.

TABLE 5(d)

| Sample No. | Kinematic viscosity (cst) 100° C. | −40° C. | After shear test, 98.9° C. | Properties of hydraulic fluid: Boiling point (°C.) DER | WER | Pour point (°C.) | Flash point (°C.) | Rubber swelling (mm) SBR, 120° C. × 70 hrs. | Remarks |
|---|---|---|---|---|---|---|---|---|---|
| 22 | 4.54 | *1,990 | 4.53 | 261 | 165 | −65 | 121 | 0.95 | Comparative fluid |
| 23 | 4.56 | *2,210 | 4.55 | 273 | 173 | −65 | 126 | 0.87 | Comparative fluid |
| 24 | 4.55 | 1,870 | 4.55 | 240 | 157 | −65 | 115 | 0.79 | Comparative fluid |
| 25 | 4.57 | 1,710 | 4.55 | 258 | 166 | −65 | 119 | 0.98 | Fluid of the present invention |
| 26 | 4.54 | 1,480 | 4.54 | 238 | *149 | −65 | 114 | 1.24 | Comparative fluid |
| 27 | 4.55 | 1,560 | 4.54 | 246 | 158 | −65 | 117 | 1.19 | Fluid of the present invention |
| 28 | 4.56 | 1,510 | 4.54 | 243 | *153 | −63 | 118 | *1.47 | Comparative fluid |
| 29 | 4.54 | *1,930 | 4.53 | 261 | 159 | −62 | 125 | *1.52 | Comparative fluid |

Note:
*This value does not pass the specifications.

It can be seen from the above Tables that the hydraulic fluid of the present invention satisfys all the specifications described in Table 3.

EXAMPLE 4

The hydraulic fluid of sample No. 5 or No. 20 produced in Example 3 was used as a base fluid, and mixed with various additives according to the formulation shown in the following Table 6 to prepare a hydraulic fluid (sample No. 5-1) and brake fluid (sample No. 20-1), and the performance of the resulting fluids as a central system hydraulic fluid or brake fluid was measured. The following Table 7 shows the SAE 71R2 and DOT-4 specifications and the performance of the fluids. It can be seen from Table 7 that the hydraulic fluid composition of the present invention satisfys all the SAE 71R2 and DOT-4 specifications.

TABLE 6

| | | Compounding ratio (Parts by weight) Sample No. | 5-1 | 20-1 |
|---|---|---|---|---|
| Base fluid | | No. 5 | 100 | — |
| | | No. 20 | — | 100 |
| Additive | Antioxidant | (1) Sumilizer MDP | 0.50 | — |
| | | Phenyl-α-naphthylamine | — | 0.50 |
| | Extreme-pressure agent | Tricresyl phosphate | 0.30 | — |
| | | Oleic acid dicyclohexylamide | — | 0.50 |
| | Anti-corrosive agent | Diethanolamine | 1.00 | 1.00 |
| | | Benzotriazole | 0.05 | 0.05 |
| | Anti-foaming | (2) Shin-Etsu Silicone KS66 | 0.001 | 0.001 |

[1] 2,2'-methylene-bis(6-t-butyl-4-methylphenol) made by Sumitomo Chemical Co., Ltd.
[2] Silicone made by Shin-Etsu Chemical Co., Ltd.

TABLE 7(a)

| Test | Performance of the hydraulic fluid of the present invention: Central system hydraulic fluid: SAE 71R2 specification | Central system hydraulic fluid: Sample No. 5-1 | Brake fluid: DOT-4 specification | Brake fluid: Sample No. 5-1 | Brake fluid: Sample No. 20-1 |
|---|---|---|---|---|---|
| Kinematic viscosity (cst) | | | | | |
| at 100° C. | — | 4.56 | 1.5 min. | 4.56 | 4.57 |
| at −40° C. | 1,800 max. | 1,670 | 1,800 max. | 1,670 | 1,600 |
| (after shear test) at 98.9° C. | 4.5 min. | 4.56 | — | — | — |
| Flash point (°C.) | 96.1 min. | 131 | 100 min. | 131 | 135 |
| Boiling point (°C.) | | | | | |
| DER | 204.4 min. | 242 | 230 min. | 242 | 261 |
| WER | — | 172 | 155 min. | 172 | 169 |
| Water content (%) | — | 3.4 | — | 3.4 | 3.3 |
| Heat stability (variation of boiling point) (°C.) | — | — | 3.0 max. | −1.0 | −1.0 |
| Chemical stability (variation of boiling point) (°C.) | — | — | 3.0 max. | −1.0 | 0 |
| Pour point (°C.) | 56.7 max. | −62 | −50 max. | −62 | −64 |
| pH | — | — | 7.0–11.5 | 8.2 | 7.9 |

TABLE 7(b)

| Test | Performance of the hydraulic fluid of the present invention: Central system hydraulic fluid: SAE 71R2 specification | Central system hydraulic fluid: Sample No. 5-1 | Brake fluid: DOT-4 specification | Brake fluid: Sample No. 5-1 | Brake fluid: Sample No. 20-1 |
|---|---|---|---|---|---|
| Corrosion resistance (mg/cm$^2$) | | | | | |
| Tinned iron sheet | ±0.2 max. | −0.06 | ±0.2 max. | −0.06 | −0.05 |
| Steel | ±0.2 max. | −0.01 | ±0.2 max. | −0.01 | −0.01 |
| Aluminum | ±0.1 max. | −0.02 | ±0.1 max. | −0.02 | −0.01 |
| Cast iron | ±0.2 max. | −0.00 | ±0.2 max. | −0.00 | −0.01 |
| Brass | ±0.5 max. | −0.09 | ±0.4 max. | −0.09 | −0.12 |
| Copper | ±0.5 max. | −0.11 | ±0.4 max. | −0.11 | −0.12 |
| Appearance of the metal | no pitching and etching | no pitching and etching | no pitching and etching | no pitching and etching | no pitching and etching |
| Property after test | | | | | |
| pH | — | — | 7.0–11.5 | 7.6 | 7.5 |
| Jellifying of fluid | — | — | no | no | no |
| Formation of crystals | — | — | no | no | no |
| Precipitate (separation by centrifuge) (vol. %) | — | — | 0.1 max. | 0.01 | 0.02 |

TABLE 7(c)

| Test | Performance of the hydraulic fluid of the present invention: Central system hydraulic fluid: SAE 71R2 specification | | Central system hydraulic fluid: Sample No. 5-1 | | Brake fluid: DOT-4 specification | | Brake fluid: Sample No. 5-1 | | Brake fluid: Sample No. 20-1 | |
|---|---|---|---|---|---|---|---|---|---|---|
| Cold test (temperature °C × hours) | −45.6 × 144 | −56.7 × 6 | −45.6 × 144 | −56.7 × 6 | −40 × 144 | −50 × 6 | −40 × 144 | −50 × 6 | −40 × 144 | −50 × 6 |
| Hiding power (identification of boundary line of test paper) | clearly identified | | clearly identified | | clearly identified | | clearly identified | | clearly identified | |
| Separation and precipitation | no | | no | | no | | no | | no | |
| Time until foams reach fluid surface (sec.) | — | — | — | — | 10 max. | 35 max. | 3 | 9 | 2 | 7 |
| Evaporability | | | | | | | | | | |
| Evaporation loss (%) | — | | — | | 80 max. | | 31 | | 38 | |
| Property and appearance of residue (sandish and abrasive precipitate) | — | | — | | no | | no | | no | |
| Pour point (°C.) | — | | — | | −5 | | −10 | | −9 | |

TABLE 7(d)

| Test | Performance of the hydraulic fluid of the present invention | | | | | | | | | |
|---|---|---|---|---|---|---|---|---|---|---|
| | Central system hydraulic fluid | | | | Brake fluid | | | | | |
| | SAE 71R2 specification | | Sample No. 5-1 | | DOT-4 specification | | Sample No. 5-1 | | Sample No. 20-1 | |
| Water tolerance (temperature °C. × hours) | −40 × 22 | 60 × 22 | −40 × 22 | 60 × 22 | −40 × 120 | 60 × 24 | −40 × 120 | 60 × 24 | −40 × 120 | 60 × 24 |
| Hiding power (identification of boundary line of test paper) | clearly identified | | clearly identified | | clearly identified | | clearly identified | | clearly identified | |
| Separation and precipitation | no | | no | | no | | no | | no | |
| Time until foams reach fluid surface (sec.) | 10 max. | — | 3 | — | 10 max. | — | 3 | — | 5 | — |
| Precipitate (separation by centrifuge) (vol. %) | — | 0.05 max. | — | 0.01 | — | 0.05 max. | 0.01 | — | — | 0.01 |
| Compatibility (temperature °C. × hours) | — | — | — | — | −40 × 24 | 60 × 24 | −40 × 24 | 60 × 24 | −40 × 24 | 60 × 24 |
| Hiding power (identification of boundary line of test paper) | — | | — | | clearly identified | | clearly identified | | clearly identified | |
| Separation and precipitation | — | | — | | no | | no | | no | |
| Precipitate (separation by centrifuge) (vol. %) | — | — | — | — | — | 0.05 max. | — | 0.03 | — | 0.01 |

TABLE 7(e)

| Test | Performance of the hydraulic fluid of the present invention | | | | |
|---|---|---|---|---|---|
| | Central system hydraulic fluid | | Brake fluid | | |
| | SAE 71R2 specification | Sample No. 5-1 | DOT-4 specification | Sample No. 5-1 | Sample No. 20-1 |
| Oxidation tolerance | | | | | |
| Pitching and etching (aluminum and cast iron) | — | — | no | no | no |
| Formation of rubbery material (metal surface) | — | — | no | no | no |
| Weight change of test metal ($mg/cm^2$) | | | | | |
| Aluminum | — | — | 0.05 max. | −0.01 | −0.02 |
| Cast iron | — | — | 0.30 max. | −0.03 | −0.05 |
| Rubber swelling (SBR, 70° C. × 120 hours) | | | | | |
| Swelling (increase of the diameter of base rubber) (mm) | — | — | 0.15–1.40 | 0.82 | 0.93 |
| Hardness IRHD (degree) | — | — | 15 max. | 2 | 3 |
| Collapse | — | — | no | no | no |

TABLE 7(f)

| Test | Performance of the hydraulic fluid of the present invention | | | | |
|---|---|---|---|---|---|
| | Central system hydraulic fluid | | Brake fluid | | |
| | SAE 71R2 specification | Sample No. 5-1 | DOT-4 specification | Sample No. 5-1 | Sample No. 20-1 |
| Rubber swelling (SBR, 120° C. × 70 hours) | | | | | |
| Swelling (increase of the diameter of base rubber) (mm) | 0.1–1.4 | 0.87 | 0.15–1.40 | 0.87 | 0.01 |
| Hardness, IRHD (degree) | — | — | 15 max. | 3 | 3 |
| Collapse | no | no | no | no | no |
| Oxidation stability in automatic transmission | 80 min. | 90 | — | — | — |
| Foaming (measuring temperature: 24 → 93.5 → 24° C. Just after air-blowing for 5 minutes (ml) | — | 40, 20, 20 | — | — | — |
| Time until foam disappears (sec.) | 100 max. | 15, 10, 10 | — | — | — |

What is claimed is:

1. A hydraulic fluid composition consisting mainly of (A) 20–60% by weight of polyoxyalkylene glycol monoalkyl ether having the following general formula (1); (B) 1–25% by weight of polyoxyalkylene glycol dialkyl ether having the following general formula (2); (C) 15–50% by weight of borate ester of polyoxyalkylene glycol monoalkyl ether having the following general formula (3), $$R^1O(C_mH_{2m}O)_nH \quad (1)$$

$$R^1O(C_mH_{2m}O)_nR^2 \quad (2)$$

$$[R^1O(C_mH_{2m}O)_n]_3B \quad (3)$$

wherein $R^1$ and $R^2$ represent alkyl groups having 1–3 carbon atoms, $C_mH_{2m}O$ represents an oxyalkylene group, m represents a positive integer of 2–4, n represents a positive integer of 2–6, and the oxyethylene group content in the total oxyalkylene group of the compounds (1), (2) and (3) is 40–90% by weight; and (D) 1–25% by weight of a high molecular weight polyoxyalkylene compound having a kinematic viscosity of at least 8 cst at 100° C. and containing at least 90% by weight of polyoxyalkylene group in the molecule and 15–80% by weight of oxyethylene group based on the total oxyalkylene group in the molecule.

2. A hydraulic fluid composition according to claim 1, wherein the oxyethylene group content in the total oxyalkylene group of the high molecular weight polyoxyalkylene compound is 40–70% by weight.

3. A hydraulic fluid composition according to claim 1, wherein the high molecular weight polyoxyalkylene compound has a solidifying point of not higher than 0° C.

4. A hydraulic fluid composition according to claim 1, wherein the high molecular weight polyoxyalkylene compound has a kinematic viscosity of 50–50,000 cst at 100° C.

5. A hydraulic fluid composition according to claim 1, wherein the high molecular weight polyoxyalkylene compound is polyoxyalkylene glycol or polyoxyalkylene glycol monoalkyl ether.

* * * * *